US005088715A

United States Patent [19]

Shibata et al.

[11] Patent Number: 5,088,715

[45] Date of Patent: Feb. 18, 1992

[54] MANUAL PAPER FEED APPARATUS HAVING A YIELDABLE SEPARATING MEMBER

[75] Inventors: Akihiro Shibata; Kenichi Okayama, both of Hachioji, Japan

[73] Assignee: Konica Corporation, Tokyo, Japan

[21] Appl. No.: 552,937

[22] Filed: Jul. 16, 1990

[30] Foreign Application Priority Data

Jul. 18, 1989 [JP] Japan ..... 1-185666
May 24, 1990 [JP] Japan ..... 2-132531

[51] Int. Cl.[5] ..... B65H 5/26; B65H 1/24
[52] U.S. Cl. ..... 271/9; 271/127
[58] Field of Search ..... 271/9, 117, 119, 120, 271/121, 126, 127

[56] References Cited

U.S. PATENT DOCUMENTS 4,062,533 12/1977 Greenberg et al. ..... 271/9
4,429,863 2/1984 Itoh et al. ..... 271/9
4,457,507 7/1984 Ishikawa et al. ..... 271/121
4,579,328 4/1986 Hagihara et al. ..... 271/119
4,696,462 9/1987 Tanaka et al. ..... 271/119
4,865,306 9/1989 Himegi ..... 271/121
4,872,660 10/1989 Kameyama et al. ..... 271/9
4,896,871 1/1990 Idenawa ..... 271/9

FOREIGN PATENT DOCUMENTS 61-174049 8/1986 Japan .
140944 6/1987 Japan ..... 271/127
62-171843 7/1987 Japan .
280136 12/1987 Japan ..... 271/9

*Primary Examiner*—Robert P. Olszewski
*Assistant Examiner*—Steven M. Reiss
*Attorney, Agent, or Firm*—Finnegan, Henderson, Farabow, Garrett and Dunner

[57] ABSTRACT

A manual paper feed apparatus includes a pivotal paper feed plate, and a paper-receiving plate. The paper-receiving plate slides in a front-rear direction upon pivotal movement of the paper feed plate. The paper-receiving plate includes a separating member which is brought into contact with a cassette pickup roller to separate a sheet of paper picked up by a manual feed pickup roller upon forward movement of the paper-receiving plate, and a slip piece which slips into a space below the cassette pickup roller. The separating member is constituted by an elastic member.

6 Claims, 5 Drawing Sheets

MANUAL PAPER FEED APPARATUS HAVING A YIELDABLE SEPARATING MEMBER

BACKGROUND OF THE INVENTION

1. Field of the Invention

The present invention relates to a manual paper feed apparatus incorporated in an image forming apparatus such as an electrophotographic copying machine.

2. Description of the Prior Art

In an electrophotographic copying machine as a typical image forming apparatus, each cassette loaded in the apparatus stores a plurality of recording sheets of a different size. A document image is recorded on a recording sheet having a size selected by a user or a recording sheet which is automatically selected in accordance with a document size.

Another copying machine can record a document image on a recording sheet having a size different from the sizes of recording sheets stored in a cassette. In this copying machine, a recording sheet having a desired size can be manually inserted from a predetermined insertion port without exchanging cassettes, and a document image can be recorded on the inserted recording sheet. An apparatus used for such an operation is called a manual paper feed apparatus.

FIGS. 1 and 2 show a conventional known manual paper feed apparatus. FIG. 1 shows a state wherein a sheet of paper is fed from a cassette. FIG. 2 shows a state wherein a sheet of paper is manually fed.

Referring to FIGS. 1 and 2, reference numeral 1 denotes a pivotal paper feed plate; and 2, a paper-receiving plate designed to slide in a front-rear direction upon pivotal movement of the pivotal paper feed plate 1. When the pivotal paper feed plate 1 is pivoted up on a support shaft 3, a proximal hook portion 2*a* is locked by a lock portion 1*a* of the plate 1, and the paper-receiving plate 2 is moved backward, as shown in FIG. 1. When the pivotal paper feed plate 1 is pivoted down as shown in FIG. 2, the paper-receiving plate 2 is pushed by a press portion 1*b* and is moved forward. During this forward movement, the paper-receiving plate 2 and the pivotal paper feed plate 1 constitute a continuous inclined surface. Reference numeral 4 denotes a paper end regulating step with which the leading end of a manually-fed sheet 5 is brought into contact. When the paper-receiving plate 2 is moved forward, the step 4 is moved to a position under a manual feed pickup roller 6 (for paper to be manually fed).

Reference numeral 7 denotes a push-up plate for urging the manually-fed sheet 5 stacked on the paper-receiving plate 2 against the pickup roller 6 via a through hole 2*b*. During the forward movement of the paper-receiving plate 2, the push-up plate 7 protrudes from the upper surface of the plate 2 via the through hole 2*b*. During the backward movement of the paper-receiving plate 2, the push-up plate 7 retreats below the plate 2.

Reference numeral 8 denotes a paper feed cassette; 9, sheets of paper stacked in the cassette 8; 10, a cassette pickup roller (for paper to be fed from the cassette); 11, a push-up plate for urging the sheet 9 against the pickup roller 10; 12, a separating member which is brought into contact with the pickup roller 10 upon forward movement of the paper-receiving plate 2; 13, a slip piece which slips under the pickup roller 10; 14, a separating roller unit; and 15, a second pickup roller pair.

In the above-described arrangement, when the pivotal paper feed plate 1 is in a vertical position as shown in FIG. 1, the sheets 9 stacked in the paper feed cassette 8 are pushed up by the push-up plate 11 and are picked up by the pickup roller 10 which is in contact therewith. The sheets 9 are then separated by the separating roller unit 14, which is located at a front position, one by one so as to be fed to the second pickup roller pair 15.

When the pivotal paper feed plate 1 is pivoted down, and the paper-receiving plate 2 is moved forward as shown in FIG. 2, the separating member 12 is brought into contact with the pickup roller 10, and the slip piece 13 slips into a space below the pickup roller 10. With this movement, the pickup roller 10 is insulated from the sheets 9 stacked in the cassette. Therefore, if the manually-fed sheet 5 is set on the paper-receiving plate 2, the sheet 5 is picked up by the pickup roller 6. The sheet 5 is then preliminarily separated by the pickup roller 10 and the separating member 12, and is finally separated by the separating roller unit 14 so as to be fed to the second pickup roller pair 15.

In the above-described manual paper feed apparatus, however, the separating member 12 is formed by directly bonding a friction member (e.g., a rubber material) to the upper surface of the paper-receiving plate 2. Therefore, when the paper feed cassette 8 is loaded, a large push-up force is applied to the slip piece 13 by the push-up plate 11 as shown in FIG. 3. As a result, the separating member 12 is urged against the pickup roller 10 with excessive pressure (an arrow B), and manual paper feed may not be performed.

SUMMARY OF THE INVENTION

The present invention has been made to solve the above-described problem, and has as its object to provide a manual paper feed apparatus which can prevent a separating member from being urged against a cassette pickup roller with excessive pressure even if a large push-up force A is applied to a slip piece under the pickup roller by a push-up plate 11 while a paper feed cassette is loaded.

In order to achieve the above object, according to the present invention, there is provided a manual paper feed apparatus comprising a pivotal paper feed plate, and a paper-receiving plate which slides in a front-rear direction upon pivotal movement of the paper feed plate, the paper-receiving plate including a separating member which is brought into contact with a cassette pickup roller to separate a sheet of paper picked up by a manual feed pickup roller upon forward movement of the paper-receiving plate, and a slip piece which slips into a space below the cassette pickup roller, wherein the separating member is constituted by an elastic member. With this arrangement, an urging force generated between the separating member and the cassette pickup roller can be reduced without degrading the separating performance.

DETAILED DESCRIPTION OF THE PREFERRED EMBODIMENTS

Figure 1:
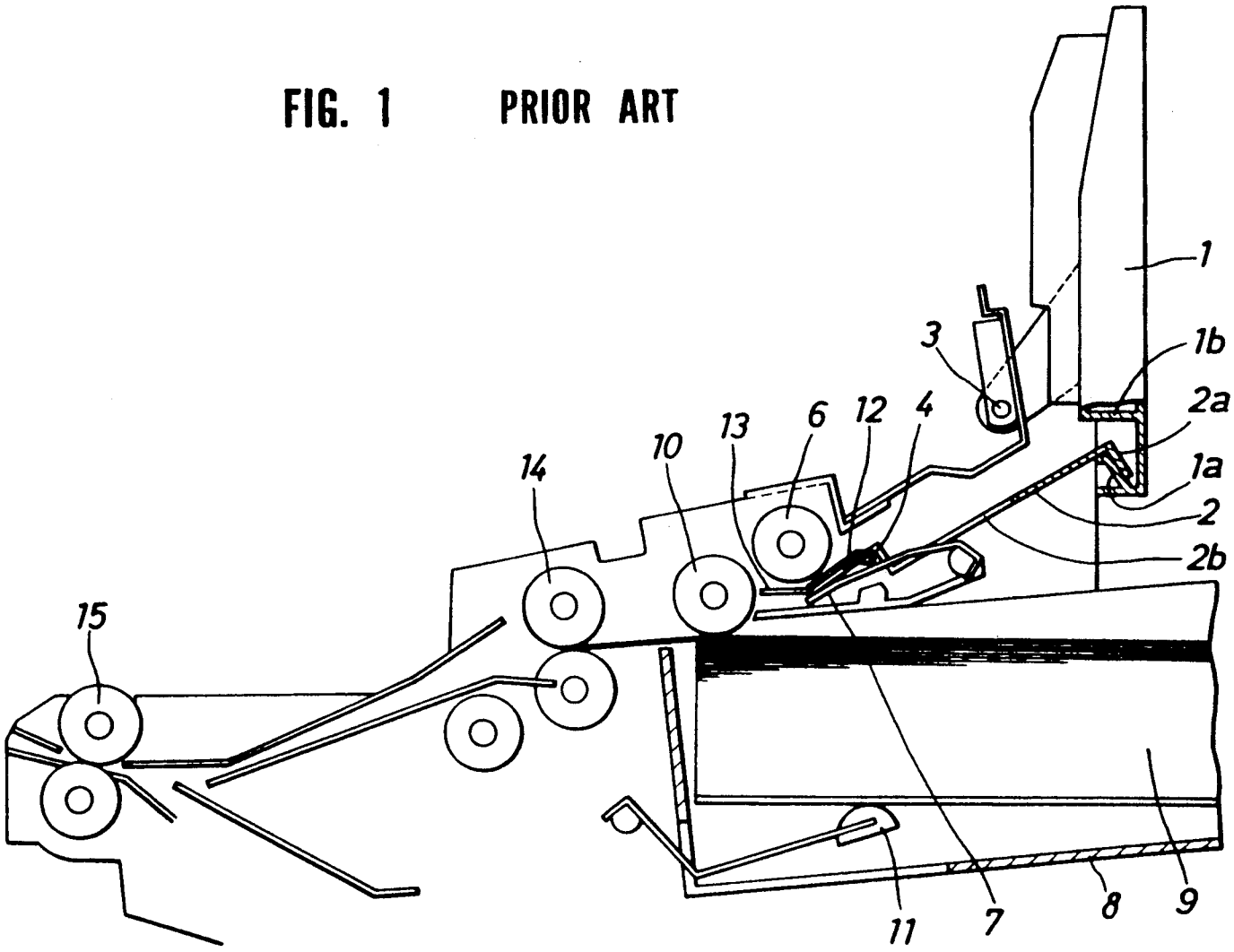
FIG. 1 PRIOR ART
FIG. 1 is a schematic view showing a main part of a conventional manual paper feed apparatus with a sheet of paper being fed from its cassette.
Figure 2:
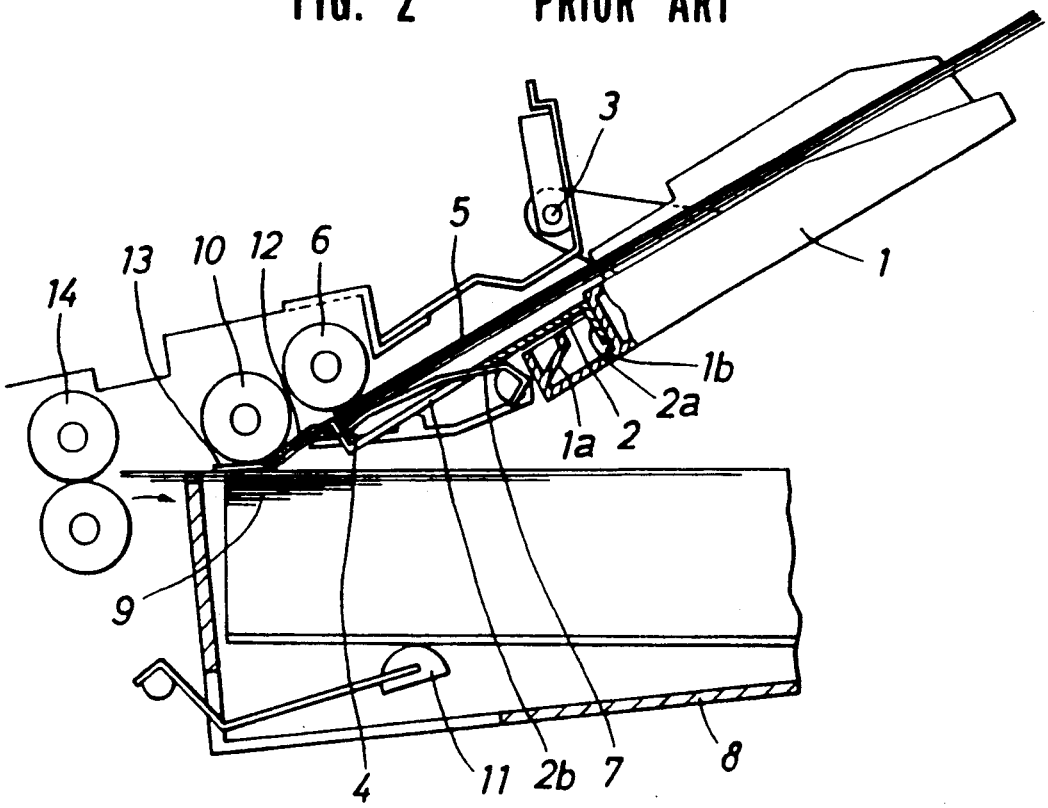
FIG. 2 PRIOR ART
FIG. 2 is a schematic view showing a main part of the conventional manual paper feed apparatus in FIG. 1 with a sheet of paper being manually fed.
Figure 3:
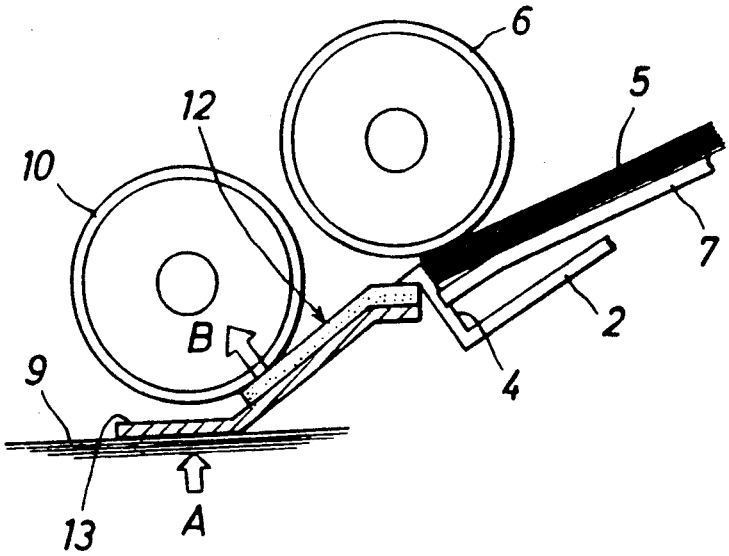
FIG. 3 PRIOR ART
FIG. 3 is an enlarged sectional view showing a separating member of the conventional manual paper feed apparatus in FIG. 1.

Embodiments of the present invention will be described below with reference to FIGS. 4–9 in which identical parts previously identified in FIGS. 1–3 are designated by the same reference numerals, modified parts corresponding to those identified in FIGS. 1–3 are designated by the same reference numerals primed and added parts are designated by new reference characters.

Figure 4:
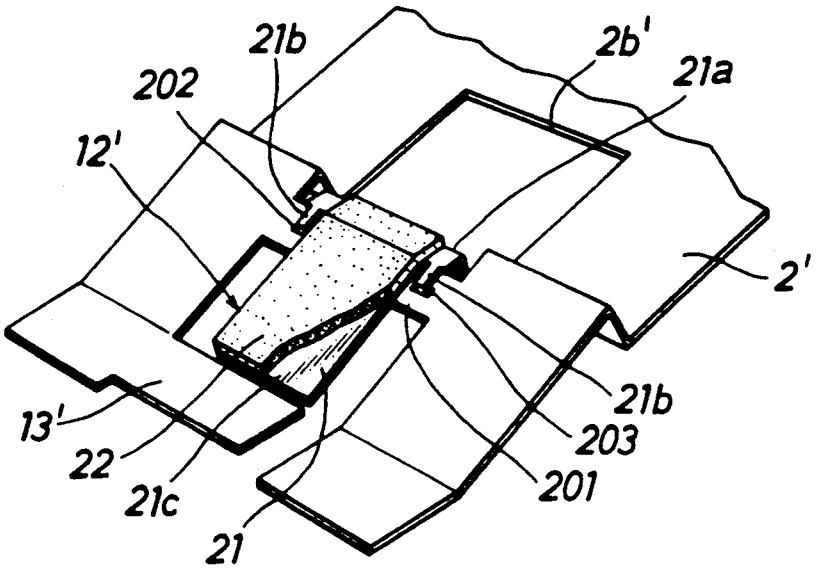
FIG. 4 is a perspective view showing a main part of an embodiment of a separating mechanism for manual paper feed in a manual paper feed apparatus of the present invention.
Figure 5:
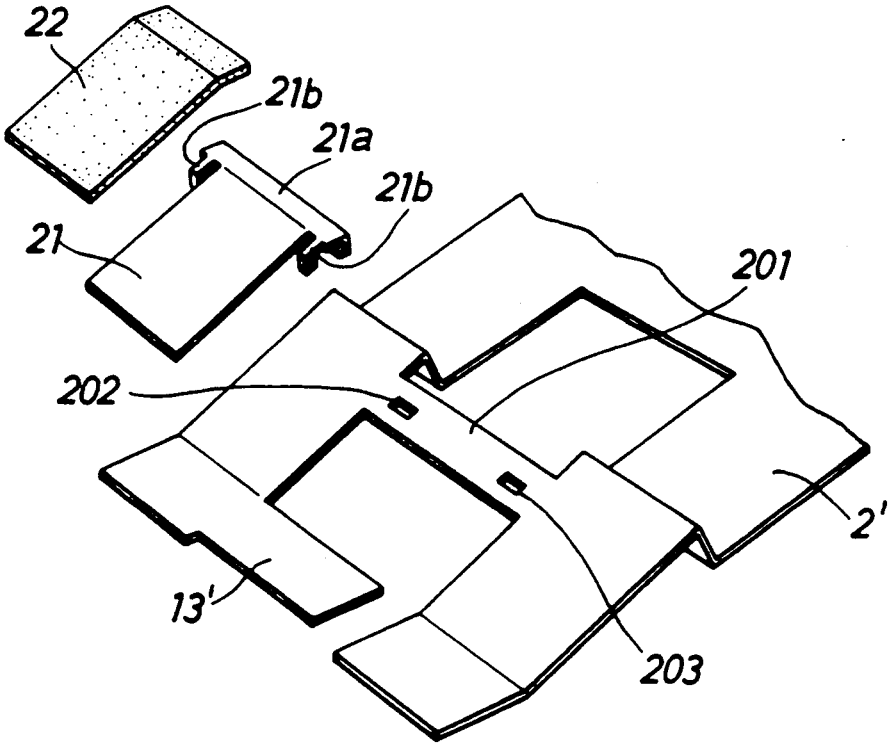
FIG. 5 is an exploded perspective view showing a main part of the separating mechanism in FIG. 4.

FIGS. 4 and 5 show a separating mechanism for manual paper feed in a manual paper feed apparatus according to an embodiment of the present invention.

In this embodiment, a separating member 12' is constituted by a leaf spring member 21 and a friction member 22 bonded to its upper surface.

The leaf spring member 21 can be realized by an SUS plate or a phosphor bronze plate. However, the present invention is not limited to this. A proximal end portion 21*a* of the leaf spring member 21 is attached to a crossbar portion 201 crossing a through hole 2*b*' of a paper-receiving plate 2'. A free end side 21*a*' of the leaf spring member 21 can easily deform elastically in the through hole 2*b*.

Figure 8:
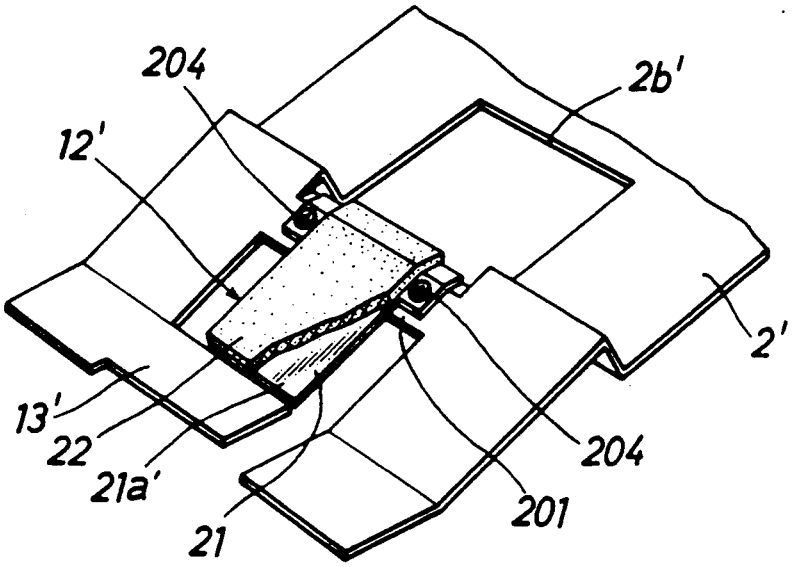
FIG. 8 is a perspective view showing a main part of another embodiment of the separating mechanism for manual paper feed in the manual paper feed apparatus of the present invention.
Figure 9:
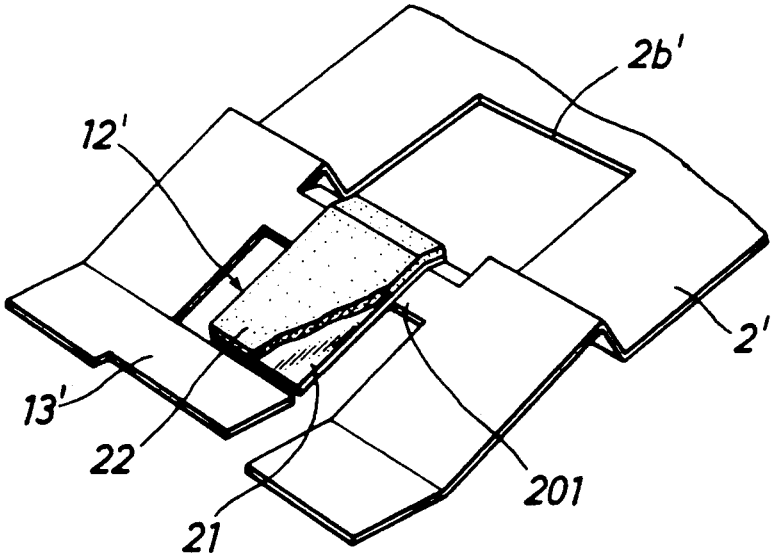
FIG. 9 is a perspective view showing a main part of still another embodiment of the separating mechanism used for the manual paper feed apparatus of the present invention.

The leaf spring member 21 may be detachably mounted or integrally fixed on the paper-receiving plate 2'. In the former case (detachable mounting), as shown in FIGS. 4 and 5, a U-shaped portion is formed on the proximal end portion 21*a* of the leaf spring member 21 so as to be fitted on the rear edge portion of the crossbar portion 201 of the paper-receiving plate 2'. At the same time, lock pawls 21*b* and 21*c* extending forward from both sides of the proximal end portion 21*a* are respectively locked in receiving holes 202 and 203 formed in the crossbar portion 201. In addition, as shown in FIG. 8, both side portions of the proximal end portion of the leaf spring member 21 may be fixed to the crossbar portion 201 of the paper-receiving plate 2' by screws 204, so that the leaf spring member 21 can be detached from the paper-receiving plate 2' by unfastening the screws 204. In the latter case (integral fixing), as shown in FIG. 9, the proximal end portion 21*a* of the leaf spring member 21 may be fixed to the crossbar portion 201 of the paper-receiving plate 2'0 by using a metal adhesive agent, brazing, or other means (e.g., a mechanical coupling means).

The friction member 22 is formed by mixing cork particles with urethane rubber. However, a friction member may be selected from other friction members having high friction coefficients.

The friction member 22 is normally bonded to the leaf spring member 21 by using an adhesive agent. However, the friction member 22 may be molded/bonded to the leaf spring member 21 by insert molding. In addition, other proper methods may be employed.

Summarizing operation of the apparatus shown in FIG. 1 and 2, when the pivotal paper feed plate 1 is pivoted down to advance the paper-receiving plate 2 from the rearward cassette feed position shown in FIG. 1 to the forward, manual sheet feed position of FIG. 2, and the paper end regulating step 4 of the paper-receiving plate 2 is moved to a position under the manual feed pickup roller 6, the slip piece 13 at the distal end of the paper-receiving plate 2 slips into a space below the cassette pickup roller 10 so as to insulate the pickup roller 10 from the sheets 9 stacked in a cassette and to urge the separating member 12 against the pickup roller 10. If the paper feed cassette 8 is loaded and a large push-up force A is applied to the slip piece 13 under the pickup roller 10 in the above-described state, the separating member 12 is urged against the pickup roller 10 with a large force.

Figure 6:
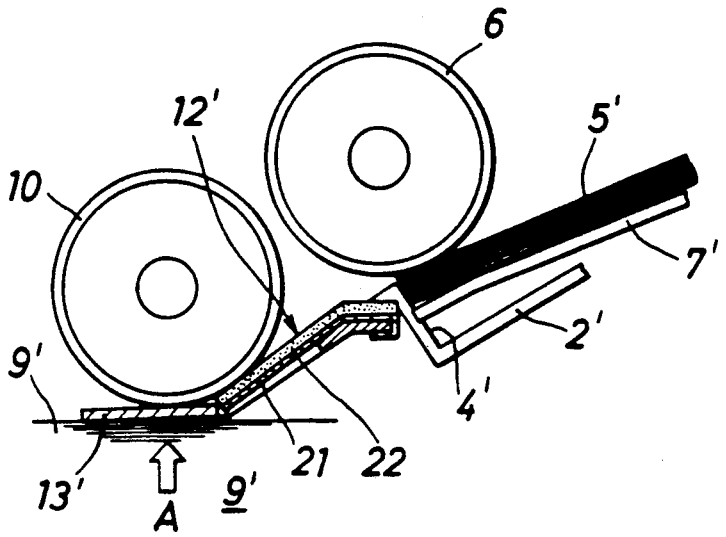
FIG. 6 is an enlarged sectional view showing a state wherein a separating member is urged against a cassette pickup roller in the manual paper feed apparatus of the present invention.
Figure 7:
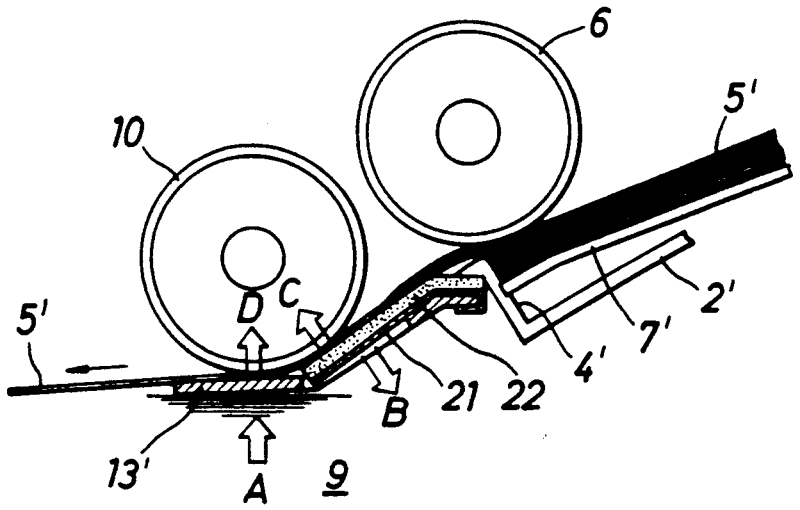
FIG. 7 is a view for explaining a manual paper feed operation of the manual paper feed apparatus of the present invention.

In the case of the present invention, however, and as shown in FIGS. 6 and 7, since the push-up force A is divided into forces C and D (FIG. 7) due to the effect of the leaf spring member 21 having the proximal end portion fixed to the crossbar portion 201 of the paper-receiving plate 2' while a sheet 5 to be manually inserted is separated, the separating member 12' is free from a state wherein paper feed cannot be performed.

As has been described above, according to the present invention, the separating member, which is arranged in contact with the pickup roller so as to separate sheets of paper picked up by the manual feed pickup roller, is constituted by an elastic member. With this arrangement, a proper separating pressure can always be obtained without excessively increasing an urging pressure between the separating member and the cassette pickup roller during a paper separating operation.

What is claimed is:

1. In a sheet feeding apparatus for alternatively feeding individual sheets manually or from a cassette contained stack, the apparatus including a cassette pickup roller, means for normally biasing said stack into engagement with said pickup roller, and a sheet receiving plate movable between a rearward cassette feed position and a forward manual feed position, said plate having a forwardly disposed slip piece positioned between said stack and said cassette pickup roller to space said stack from said pickup roller when said plate is in said forward position, and a separating member to contact said pickup roller when said plate is in said forward position to separate a manually fed sheet, the improvement wherein said separating member is yieldably displaceable relative to said plate.

2. An apparatus according to claim 1, wherein said separating member comprises a leaf spring member which is fixed to said paper-receiving plate and can be flexibly bent upon coming into contact with said cassette pickup roller, and a friction member mounted on said leaf spring member.

3. An apparatus according to claim 2, wherein said leaf spring member is detachably mounted on said paper-receiving plate.

4. An apparatus according to claim 2, wherein said leaf spring plate is made of an SUS material.

5. An apparatus according to claim 2, wherein said friction member is formed by mixing cork particles with urethane rubber.

6. An apparatus according to claim 2, wherein said friction member is molded or bonded to said leaf spring member by insert molding.

* * * * *